US005344035A

United States Patent [19]

Manera

[11] Patent Number: 5,344,035

[45] Date of Patent: Sep. 6, 1994

[54] CHILD RESISTANT CLOSURE

[75] Inventor: David A. Manera, Vineland, N.J.

[73] Assignee: Comar Inc., Buena, N.J.

[21] Appl. No.: 186,852

[22] Filed: Jan. 27, 1994

Related U.S. Application Data

[63] Continuation-in-part of Ser. No. 974,228, Nov. 10, 1993, abandoned.

[51] Int. Cl.[5] ..... B65D 55/02

[52] U.S. Cl. ..... 215/219; 215/206

[58] Field of Search ..... 215/201, 206, 208, 216, 215/217, 218, 219, 221, 223, 230, 330, 334

[56] References Cited

U.S. PATENT DOCUMENTS

| | | | |
|---|---|---|---|
| 2,372,482 | 3/1945 | Genei | 215/206 X |
| 2,381,207 | 8/1945 | Coleman | 215/206 |
| 3,138,277 | 6/1964 | Milbourne | 215/219 X |
| 3,164,277 | 1/1965 | Reading | 215/219 X |
| 3,468,444 | 9/1969 | Martin, Jr. | 215/219 X |
| 3,501,041 | 3/1970 | Schaefer | 215/219 |
| 3,615,036 | 10/1971 | Mross | 215/218 X |
| 3,710,970 | 1/1973 | Elfline | 215/219 |
| 5,115,928 | 5/1992 | Drummond, Jr. | 215/219 |
| 5,148,931 | 9/1992 | Minh | 215/220 |
| 5,170,900 | 12/1992 | Manera | 215/218 |

*Primary Examiner*—Allan N. Shoap
*Assistant Examiner*—Stephen Cronin
*Attorney, Agent, or Firm*—Brady, O'Boyle & Gates

[57] ABSTRACT

A child resistant closure for a container wherein an outer cap is freely rotatable on an inner cap. A pair of oppositely extending latch tabs extend through passageways provided in the inner cap into recesses provided in the outer cap to couple the inner and outer caps for removal of the closure from the container. The latch tab members are connected to a manually rotatable hub so that the latch tab members are simultaneously moved to the coupled position. The recesses in the outer cap are provided with cam surfaces engagable with the latch tabs for automatically moving the latch tabs to the released position into the passageways during the securing of the closure to the bottle. Indicia are provided on the outer cap and hub member to indicate when the passageways and recesses are aligned and when the latch tabs have been extended into the recesses.

11 Claims, 2 Drawing Sheets

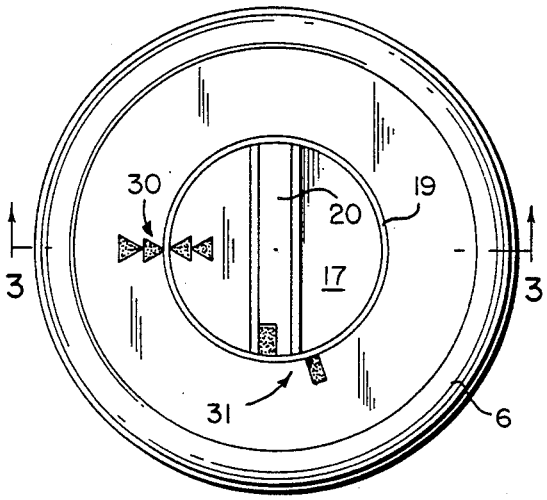
Fig. 1
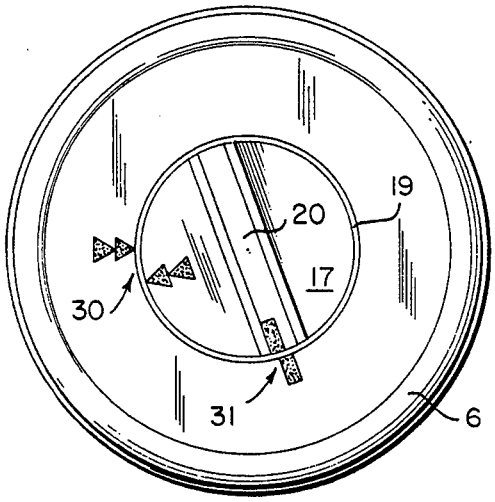
Fig. 2
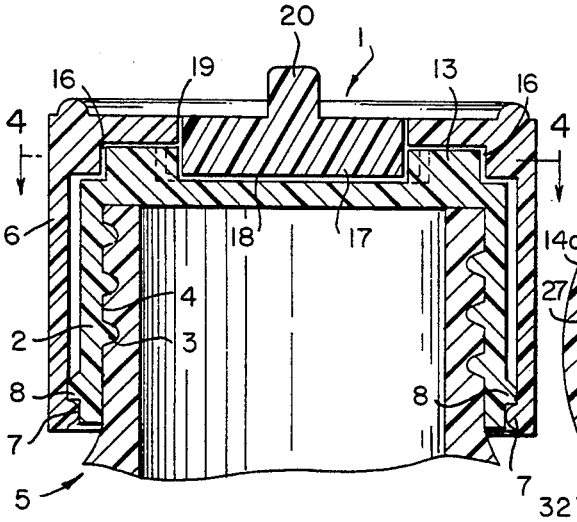
Fig. 3
Fig. 4
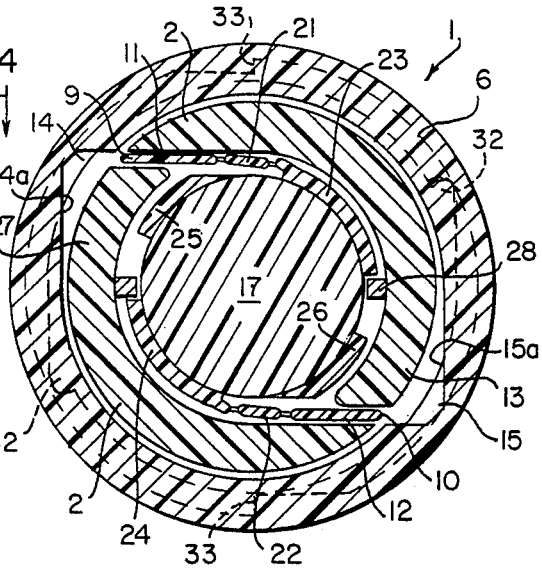

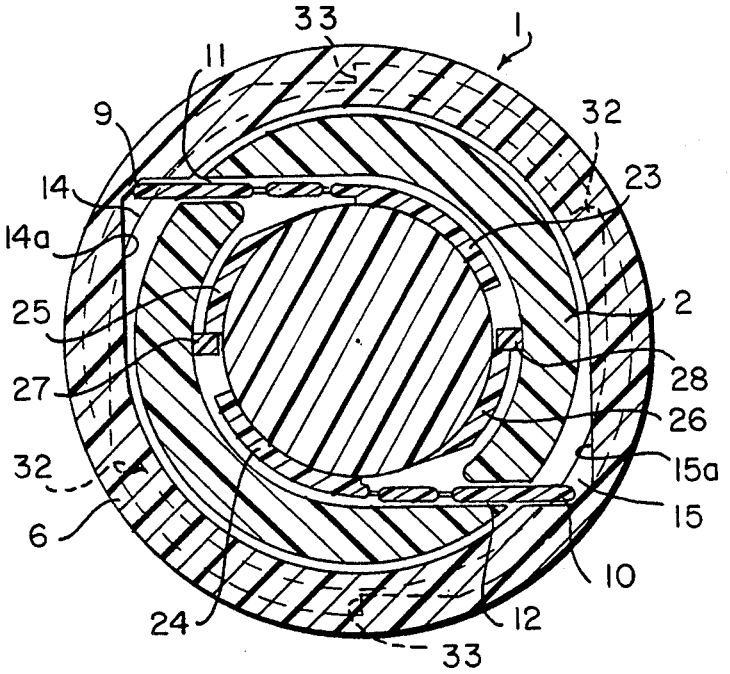
Fig. 5
Fig. 6
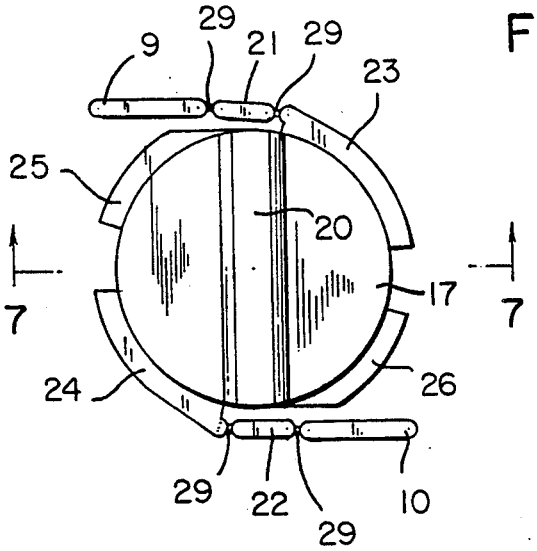
Fig. 7
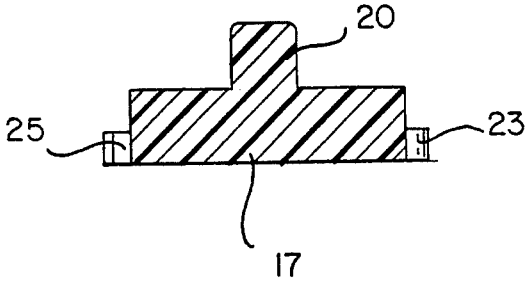

CHILD RESISTANT CLOSURE

CROSS-REFERENCE TO RELATED APPLICATION

This application is a continuation-in-part of application Ser. No. 07/974,228, filed Nov. 10, 1993, now abandoned.

BACKGROUND OF THE INVENTION

This application is related to the child resistant closure disclosed in applicant's pending application Ser. No. 07/878,914, filed May 6, 1992, now U.S. Pat. No. 5,170,900, dated Dec. 15, 1992, wherein an outer cap is freely rotatable on an inner cap and a latch assembly is positioned between the top walls of the inner and outer caps for connecting the inner and outer caps together, whereby the closure can be removed from the bottle. The latch assembly includes a post integral with the top wall of the inner cap and a latch member slidably mounted in the space between the top walls of the inner and outer caps for engagement with the post to interconnect the inner and outer caps. An aperture is provided in the top wall of the outer cap alignable with a top surface of the post, whereby the position of the post can be observed to indicate alignment of the latch member with the post preparatory to sliding the latch member into engagement with the post.

SUMMARY OF THE INVENTION

The child resistant closure of the present invention is another embodiment of the child resistant closure disclosed in applicant's aforementioned patent and comprises, essentially, an inner cap having internal threads for engagement with threads on a container and an outer cap freely rotatable on the inner cap. Tangentially extending passageways in the inner cap are alignable with recesses in the outer cap through which plastic latch tabs extend to interconnect the inner and outer caps for removal of the closure from the container. The plastic latch tabs are connected to a rotable hub which is manually rotated to extend the tabs through the passageways and into the recesses for interconnecting the inner and outer caps. The configuration of the recesses is such that the tabs are cammed to the released position when the closure is tightened to the closed position on the container.

Indicia is provided on the top surface of the outer cap and the top surface of the hub to indicate when the recesses in the outer cap and passageways in the inner cap are aligned preparatory to rotating the hub to extend the latch tabs through the passages of the inner cap and into the recesses of the outer cap, and also to indicate that the inner and outer caps are coupled for removal of the closure.

BRIEF DESCRIPTION OF THE DRAWINGS

FIG. 1 is a top plan view of the closure of the present invention wherein the outer cap and inner cap have been rotated to a position where the recesses in the outer cap are aligned with the passageways in the inner cap;

FIG. 2 is a top plan view similar to FIG. 1 wherein the hub member has been rotated to move the latch tabs to a position interconnecting the inner and outer caps;

FIG. 3 is a view taken along line 3—3 of FIG. 1;

FIG. 4 is a view taken along line 4—4 of FIG. 3;

FIG. 5 is a view similar to FIG. 4 wherein the hub has been rotated to extend the latch tabs to connect the inner and outer caps;

FIG. 6 is a top plan view of the hub and associated latch tabs; and

FIG. 7 is a view taken along line 7—7 of FIG. 6.

DESCRIPTION OF THE PREFERRED EMBODIMENT

Referring to the drawings and more particularly to FIGS. 3 and 4, the child resistant closure 1 of the present invention comprises an inner cap 2 having internal threads 3 for engagement with threads 4 on the neck of a container 5. An outer cap 6 is captured on the inner cap 2 by a radially inwardly extending bead 7 formed on the bottom of the skirt portion on the outer cap 6 engaging the lower surface of a radially outwardly extending flange 8 formed on the corresponding lower skirt portion on the inner cap 2, whereby the outer cap 6 is freely rotatable on the inner cap 2 when the closure is rotated in a counterclockwise direction in an attempt to remove the closure 1 from the container 5.

In order that the inner and outer caps 2 and 6 can be interconnected for removal of the closure 1 from the container 5, a latch assembly including a pair of oppositely extending latch tabs 9 and 10 are provided and which are slidably mounted in tangentially extending passageways 11, 12 provided in an annular wall 13 extending upwardly from the top wall of the inner cap 2. The outer cap 6 is provided with a pair of recesses 14 and 15 provided in a side wall portion 16 of the outer cap 6 adjacent the top wall thereof. The tabs 9 and 10 are adapted to extend through the passageways 11 and 12 and into the recesses 14 and 15, as shown in FIG. 5, to thereby interconnect the inner and outer caps 2 and 6, whereby the closure 1 can be removed from the container 15.

An operator for actuating the latch tabs 9 and 10 is provided, as shown in FIGS. 3, 6 and 7, and comprises a hub member 17 rotatably mounted in a recess 18 provided in the top wall of the inner cap 2 and extending upwardly through a central opening 19 provided in the top wall of the outer cap 6. The top surface of the hub 17 is provided with an integral handle portion 20 to facilitate manually rotating the hub member 17. The inner ends of the latch tabs 9 and 10 are connected to the outer ends of link members 21, 22 having their inner ends connected to arcuate flange members 23, 24 integral with the side wall of the hub 17. The hub side wall is provided with additional, circumferentially spaced flanges 25, 26 adapted to engage radially inwardly extending abutment members 27 and 28 provided on the inner surface of the annular wall 13 of the inner cap when the latch tabs 9 and 10 have been moved to the operative position, as shown in FIG. 5. The free ends of the flange members 23, 24 engage the abutments 27, 28 when the latch tabs 9 and 10 have been moved to the released position as shown in FIG. 4. The tabs 9, 10, links 21, 22 and associated flange members 23, 24 are made of plastic having integral or living hinge portions 29.

As will be seen in FIG. 1, indicia 30 in the form of arrows is provided on the top surfaces of the outer cap 6 top wall and the hub member 17 to indicate when the passageways 11 and 12 are aligned with the recesses 14 and 15, as shown in FIG. 4. Additional indicia 31 in the form of bars are provided on the handle portion 20 and the top wall of the outer cap 2, which are alignable as shown in FIG. 2, to indicate that the latch tabs 9 and 10 are inserted into the recesses 14 and 15, thereby interconnecting the inner and outer caps, whereby the closure 1 is removable from the container.

Referring to FIGS. 3 and 4, and as disclosed in my aforementioned patent, the annular wall 13 is provided with a plurality of circumferentially spaced, radially outwardly extending teeth 32 adapted to engage correspondingly-shaped, oppositely extending, circumferentially spaced teeth 33 formed integral with the inner surface of the skirt portion of the outer cap 6 in proximity to the top wall thereof.

In the operation of the closure 1, when it is desired to remove the closure from the container, the outer cap 6 is rotated to a position to align the arrows 30, as shown in FIG. 1, whereby the passageways 11 and 12 on the inner cap 2 are aligned with the recesses 14 and 15, as shown in FIG. 4. The hub member 17 is then rotated to the position illustrated in FIG. 2 to align the bars 31, whereby the latch tabs 9 and 10 are moved in opposite directions into the recesses 14 and 15, to thereby couple the inner cap 2 to the outer cap 6, as shown in FIG. 5. The closure 1 can then be rotated in a counterclockwise direction to remove it from the container 15.

The recesses 14 and 15 are provided with inclined walls 14*a* and 15*a*, whereby when the closure 1 is rotated in a clockwise direction to tighten the closure 1 onto the container 15, the ends of the latch tabs 9 and 10 will slide on the inclined walls 14*a* and 15*a* to be cammed by the walls back into the passageways 11 and 12, as shown in FIG. 4, thereby disconnecting the inner and outer caps 2 and 6 from each other. Continued rotation of the outer cap 2 will cause the teeth 32 and 33 to become engaged, whereby the inner cap 2 and outer cap 6 move in unison onto the threaded neck of the container 5. When the closure 1 reaches the position shown in FIG. 4, it will be secured to the container and the inner and outer caps 2 and 6 will be uncoupled so that the outer cap 6 is freely rotatable on the inner cap 2, whereby the closure cannot be removed from the container by merely rotating the closure in a counterclockwise direction.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A child resistant closure for a container comprising, an inner cap having internal threads for engagement with threads on the container, an outer cap freely rotatable on said inner cap in a closure removal direction, each of said caps having a top wall and a depending skirt portion, the top wall of said outer cap being spaced above the top wall of said inner cap, an annular wall positioned in said space and being integral with the top wall of said inner cap and extending upwardly therefrom, at least one passageway extending through said annular wall, at least one recess in a portion of the skirt of the outer cap alignable with said passageway, at least one latch tab slidably mounted in said passageway, and means mounted on the top wall of said inner cap and connected to said at least one latch tab for sliding said at least one latch tab into the recess to thereby interconnect the inner and outer caps, whereby the closure can be removed from the container.

2. A child resistant closure according to claim 1, wherein the means for sliding the at least one latch tab comprises, a manually rotatable hub member, a recess provided in the top wall of said inner cap, and an opening provided in the top wall of said outer cap, said hub member being rotatably mounted in said recess and extending through the opening in the outer cap.

3. A child resistant closure according to claim 2, wherein one end of the at least one latch tab is connected to one end of a link, the opposite end of said link being connected to said hub member.

4. A child resistant closure for a container comprising, an inner cap having internal threads for engagement with threads on the container, an outer cap freely rotatable on said inner cap in a closure removal direction, each of said caps having a top wall and a depending skirt portion, the top wall of said outer cap being spaced above the top wall of said inner cap, an annular wall positioned in said space and being integral with the top wall of said inner cap and extending upwardly therefrom, a pair of circumferentially spaced passageways extending through said wall, a pair of circumferentially spaced recesses provided in a portion of the skirt of the outer cap, said recesses being alignable with said passageways, a latch tab slidably mounted in each passageway, and means mounted on the top wall of said inner cap and connected to each latch tab for sliding the latch tabs into the recesses to thereby interconnect the inner and outer caps, whereby the closure can be removed from the container.

5. A child resistant closure according to claim 4, wherein the means for sliding the latch tabs comprises, a manually rotatable hub member, a recess provided in the top wall of said inner cap, and an opening provided in the top wall of said outer cap, said hub member being rotatably mounted in said recess and extending through the opening in the outer cap.

6. A child resistant closure according to claim 5, wherein a pair of circumferentially spaced arcuate flange members are connected to the side wall of said hub member, a pair of links, each link having one end connected to an end of a respective flange member, the opposite end of each link being connected to one end of a respective latch tab, whereby upon rotation of said hub member the latch tabs extend in opposite directions into the recesses in the outer cap to couple the inner and outer caps.

7. A child resistant closure according to claim 6, wherein a second pair of circumferentially spaced arcuate flange members are connected to the side wall of said hub member, a pair of circumferentially spaced, radially inwardly extending abutment members connected to the inner surface of the portion of the skirt of the outer cap, said second pair of arcuate flanges engaging said abutment members when the latch tabs have been moved to the coupled position, the first pair of arcuate flanges engaging said abutment members when the latch members have been moved to the released position.

8. A child resistant closure according to claim 7, wherein indicia is placed on the top surfaces of the outer cap top wall and the hub member to indicate when the passageways are aligned with the recesses.

9. A child resistant closure according to claim 8, wherein additional indicia is placed on the hub member and top wall of the outer cap to indicate that the latch tabs are inserted into the recesses, thereby interconnecting the inner and outer caps, whereby the closure is removable from the container.

10. A child resistant closure according to claim 6, wherein the latch tabs, links and associated flange members are made of plastic having integral hinge portions.

11. A child resistant closure according to claim 6, wherein the recesses are provided with inclined walls engaged by the ends of the latch tabs, whereby when the closure is rotated in a direction to tighten the closure onto the container, the ends of the latch tabs slide on the inclined walls and are cammed by the walls back into the passageways, said inner and outer caps provided with means for engagement of the inner and outer caps when the closure is rotated in the closure tightening direction.

* * * * *